US010018416B2

(12) United States Patent
Leininger et al.

(10) Patent No.: US 10,018,416 B2
(45) Date of Patent: Jul. 10, 2018

(54) SYSTEM AND METHOD FOR REMOVAL OF LIQUID FROM A SOLIDS FLOW

(71) Applicant: General Electric Company, Schenectady, NY (US)

(72) Inventors: Thomas Frederick Leininger, Chino Hills, CA (US); John Saunders Stevenson, Anaheim, CA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 943 days.

(21) Appl. No.: 13/705,154

(22) Filed: Dec. 4, 2012

(65) Prior Publication Data

US 2014/0150288 A1 Jun. 5, 2014

(51) Int. Cl.
*F26B 5/14* (2006.01)

(52) U.S. Cl.
CPC ..... *F26B 5/14* (2013.01)

(58) Field of Classification Search
CPC ..... F26B 5/14; B01D 3/343
USPC ..... 34/500
See application file for complete search history.

(56) References Cited

U.S. PATENT DOCUMENTS 1,459,923 A * 6/1923 Nagel ..... F26B 17/04 34/182
1,813,575 A * 7/1931 Janecke ..... C01D 3/08 23/297
2,873,032 A * 2/1959 Henry ..... E21B 21/066 175/206
3,035,306 A * 5/1962 Rossiter ..... B29B 7/842 100/117
3,205,161 A * 9/1965 Turner ..... B01D 17/06 204/662
3,305,091 A * 2/1967 Brady ..... B07B 4/025 159/4.04
3,602,552 A * 8/1971 Morgan ..... F04D 3/02 198/672
3,841,465 A * 10/1974 Miller, Jr. ..... F23G 5/444 162/18
3,865,727 A * 2/1975 Broling ..... B01D 29/035 209/283

(Continued)

FOREIGN PATENT DOCUMENTS

CN 86104452 A 4/1987
CN 101525118 A 9/2009

(Continued)

OTHER PUBLICATIONS

U.S. Appl. No. 13/705,149, filed Dec. 4, 2012, John Saunders Stevenson.

(Continued)

*Primary Examiner* — Kenneth Rinehart
*Assistant Examiner* — Logan Jones
(74) *Attorney, Agent, or Firm* — Fletcher Yoder, P.C.

(57) ABSTRACT

A system includes a multi-feeder assembly. The multi-feeder assembly includes a first solids feeder, a liquid removal section, and a second solids feeder. The first solids feeder is configured to receive a solids flow from an upstream system. The liquid removal section is configured to reduce an amount of liquid in the solids flow. The second solids feeder is configured to receive the solids flow in series with the first solids feeder and output the solids flow to a downstream system.

13 Claims, 4 Drawing Sheets

(56) References Cited

U.S. PATENT DOCUMENTS 3,875,051 A * 4/1975 Kovarik ..... C02F 3/1242 210/104
3,882,946 A 5/1975 Ioannesian et al.
3,944,380 A 3/1976 Kampe
3,992,784 A 11/1976 Verschuur et al.
4,017,270 A 4/1977 Funk et al.
4,106,533 A * 8/1978 Herzig ..... C10J 3/50 141/1
4,106,553 A 8/1978 Nakamura et al.
4,126,519 A * 11/1978 Murray ..... C10B 1/04 201/20
4,176,465 A * 12/1979 Murray ..... F26B 3/00 34/182
4,204,955 A 5/1980 Armstrong
4,236,868 A 12/1980 Linhardt
4,292,991 A 10/1981 Wing
4,313,737 A 2/1982 Massey et al.
4,322,389 A 3/1982 Schmid et al.
4,377,392 A 3/1983 Massey et al.
4,434,028 A * 2/1984 Eppig ..... B01D 11/0203 196/14.52
4,472,171 A 9/1984 Broderick
4,477,257 A * 10/1984 Koppelman ..... C10F 7/00 44/632
4,516,674 A 5/1985 Firth et al.
4,666,464 A 5/1987 Najjar et al.
4,668,130 A * 5/1987 Sharp ..... B65G 53/48 15/104.095
4,701,266 A * 10/1987 Janka ..... B01D 21/04 210/523
4,765,781 A 8/1988 Wilks et al.
4,801,210 A 1/1989 Gian
4,828,581 A 5/1989 Feldmann et al.
4,907,565 A 3/1990 Bailey et al.
4,967,673 A * 11/1990 Gunn ..... C10B 49/02 110/188
5,050,375 A 9/1991 Dickinson
5,051,041 A 9/1991 Firth
5,102,237 A 4/1992 Ide
5,188,741 A 2/1993 Zang et al.
5,223,144 A 6/1993 Woyciesjes et al.
5,223,199 A 6/1993 Ponzielli
5,269,635 A 12/1993 Taylor, Jr.
5,355,993 A 10/1994 Hay et al.
5,356,280 A 10/1994 Ponzielli
5,381,886 A 1/1995 Hay
5,402,876 A 4/1995 Hay
5,443,162 A * 8/1995 Sherman ..... B01D 29/071 209/274
5,459,674 A 10/1995 Ide et al.
5,485,909 A * 1/1996 Hay ..... F04D 5/001 198/642
5,495,674 A 3/1996 Taylor
5,497,872 A 3/1996 Pennino et al.
5,551,553 A 9/1996 Hay et al.
5,657,704 A * 8/1997 Schueler ..... C21B 5/003 110/101 R
5,685,153 A 11/1997 Dickinson et al.
5,753,075 A 5/1998 Stromberg et al.
5,797,332 A 8/1998 Keller et al.
5,823,235 A * 10/1998 Alley ..... F17C 13/025 137/456
5,836,524 A * 11/1998 Wang ..... C10B 7/10 241/23
5,853,488 A * 12/1998 Silver ..... A23L 1/3081 127/34
6,090,423 A * 7/2000 Wetzel ..... A23L 1/0128 34/499
6,141,796 A 11/2000 Cummings
6,213,033 B1 * 4/2001 Manelis ..... F23G 5/16 110/229
6,213,289 B1 4/2001 Hay et al.
6,280,638 B1 * 8/2001 Belchev ..... B01D 25/164 210/196
6,375,841 B1 * 4/2002 Nemedi ..... B04B 3/00 209/12.1
6,398,921 B1 * 6/2002 Moraski ..... C02F 1/302 110/346
6,640,696 B2 * 11/2003 Shinobudani ..... A23L 3/0155 99/467
6,706,199 B2 * 3/2004 Winter ..... B65G 33/265 210/415
7,074,339 B1 * 7/2006 Mims ..... B01D 21/0018 210/170.08
7,229,524 B2 * 6/2007 Snekkenes ..... D21C 7/06 162/18
7,335,311 B2 * 2/2008 Christophersson ..... B30B 9/121 100/117
7,374,734 B2 5/2008 Grossman et al.
7,493,969 B2 * 2/2009 Burnett ..... B63B 27/20 175/206
7,562,777 B1 7/2009 Seenivasan
7,731,783 B2 6/2010 Sprouse et al.
7,745,568 B2 * 6/2010 Vandaele ..... B01J 8/003 34/259
8,434,641 B2 * 5/2013 Coughlin ..... G07F 11/16 221/174
8,470,183 B2 * 6/2013 DeWaard ..... B01D 21/2461 198/666
8,496,412 B2 * 7/2013 Livingood, III ..... B65G 53/48 406/14
8,561,319 B2 * 10/2013 He ..... C02F 11/12 34/189
8,926,231 B2 * 1/2015 Liu ..... C10J 3/30 406/53
8,926,846 B2 * 1/2015 DeWaard ..... B65G 33/12 198/666
8,951,314 B2 2/2015 Leininger et al.
8,992,641 B2 3/2015 Leininger et al.
9,222,040 B2 12/2015 Steele et al.
2001/0006811 A1 * 7/2001 Horigane ..... B01F 7/081 435/290.4
2001/0026783 A1 * 10/2001 Winter ..... B65G 33/265 422/271
2001/0032780 A1 * 10/2001 Winter ..... B65G 33/265 202/117
2002/0110296 A1 * 8/2002 Smith ..... F16C 17/24 384/276
2002/0130086 A1 * 9/2002 Miura ..... B01D 21/0018 210/705
2004/0107700 A1 6/2004 McClanahan et al.
2005/0107648 A1 * 5/2005 Kimura ..... B01J 19/10 585/15
2005/0177013 A1 8/2005 Countz
2006/0096163 A1 5/2006 Dickinson et al.
2006/0130357 A1 * 6/2006 Long, Jr. ..... F26B 17/04 34/389
2006/0165582 A1 7/2006 Brooker et al.
2006/0166810 A1 * 7/2006 Gunderman ..... B01D 61/20 502/64
2008/0045762 A1 * 2/2008 Foody ..... B09B 3/00 585/240
2008/0145156 A1 * 6/2008 Livingood ..... B65G 53/48 406/14
2008/0251454 A1 * 10/2008 Waibel ..... B01D 11/0203 210/634
2008/0287277 A1 * 11/2008 Pallmann ..... B30B 9/12 494/53
2009/0107046 A1 4/2009 Leininger et al.
2009/0178338 A1 7/2009 Leininger et al.
2009/0217666 A1 9/2009 Farkaly
2010/0242354 A1 9/2010 Perkins et al.
2011/0068063 A1 * 3/2011 Mallonee ..... B09C 1/00 210/770
2011/0072723 A1 * 3/2011 Liu ..... C10J 3/30 48/86 R
2011/0091953 A1 4/2011 Bolin et al.

(56) References Cited

U.S. PATENT DOCUMENTS

2011/0100359 A1* 5/2011 North ..... C08H 8/00 127/1
2011/0139257 A1* 6/2011 Bielenberg ..... B01J 8/003 137/1
2011/0171114 A1* 7/2011 Shaw ..... C08J 11/12 423/566.1
2011/0232191 A1 9/2011 Diebold et al.
2011/0251440 A1 10/2011 Huegle et al.
2012/0067047 A1 3/2012 Peterson et al.
2012/0067702 A1* 3/2012 Frey ..... B65G 53/4633 198/642
2012/0171054 A1* 7/2012 Russell ..... F02C 3/28 417/85
2012/0198768 A1 8/2012 Khosravian et al.
2012/0205222 A1* 8/2012 Russell ..... F04C 13/007 198/804
2012/0234652 A1* 9/2012 Stevenson ..... B65G 19/04 198/701
2012/0255706 A1 10/2012 Tadayon et al.
2012/0282467 A1 11/2012 Iyer et al.
2013/0019530 A1 1/2013 Favilli et al.
2013/0098765 A1* 4/2013 Stradi ..... B30B 9/121 204/518
2013/0126002 A1 5/2013 Bathurst
2013/0255143 A1* 10/2013 Frey ..... F26B 21/10 44/629
2013/0259671 A1* 10/2013 Leininger ..... G01F 13/001 415/208.1
2013/0269735 A1* 10/2013 Roetzel ..... E21B 21/062 134/40
2013/0276822 A1* 10/2013 Plavidal ..... B08B 3/04 134/3
2013/0295628 A1* 11/2013 Retsina ..... C08H 8/00 435/160
2013/0327028 A1* 12/2013 Steele ..... C10J 3/526 60/327
2014/0027246 A1* 1/2014 Stevenson ..... F04B 15/02 198/707
2014/0110320 A1* 4/2014 Thomas ..... F26B 5/14 210/137
2014/0123973 A1* 5/2014 North ..... C08H 8/00 127/37
2014/0150288 A1 6/2014 Leininger et al.
2014/0150873 A1* 6/2014 Stevenson ..... B65G 53/66 137/1
2014/0151191 A1* 6/2014 Stevenson ..... B65G 53/48 198/572
2015/0090938 A1 4/2015 Meyer et al.
2015/0159097 A1 6/2015 Yen
2015/0159503 A1 6/2015 Leininger et al.
2015/0159654 A1 6/2015 Leininger et al.

FOREIGN PATENT DOCUMENTS

CN 101952658 A 1/2011
EP 0256186 A1 2/1988
EP 0343620 A2 11/1989
EP 0418442 A1 3/1991
EP 0646746 A2 4/1995
EP 1500863 A2 1/2005
EP 1256375 B1 1/2011
EP 2386621 A2 11/2011
FR 2811380 A1 1/2002
FR 2811380 B1 10/2002
GB 191024001 A 7/1911
GB 1457839 A 12/1976
PL 404251 A1 12/2013
RU 2376493 C2 12/2009
RU 2421612 C1 6/2011
WO 9624810 8/1996
WO 9825027 A1 6/1998
WO 9943954 9/1999
WO 0053924 A2 9/2000
WO 0202935 A1 1/2002
WO 03067082 A1 8/2003
WO 2011121423 A2 10/2011
WO 2011/139164 A1 11/2011
WO 2012/040110 A2 3/2012
WO 2013087521 A2 6/2013

OTHER PUBLICATIONS

U.S. Appl. No. 13/705,161, filed Dec. 4, 2012, John Saunders Stevenson.

Stamet Inc., Continuous Mechanically Controlled Solids Ash Metering from High to Low Gas Pressure, SBIR/STTR, http://www.sbir.gov/sbirsearch/detail/316954, 1997.

Perry, Robert H., Process Machinery Drives: Expansion Turbines, Perry's Chemical Engineers' Handbook, Sixth Edition, 1984, pp. 24-32 thru 24-37.

* cited by examiner

SYSTEM AND METHOD FOR REMOVAL OF LIQUID FROM A SOLIDS FLOW

BACKGROUND OF THE INVENTION

The subject matter disclosed herein relates to systems and methods for removing liquid from a solids flow.

Liquid removal systems are used in a variety of industries to reduce an amount of liquid in a flow of solid material. Unfortunately, existing liquid removal systems may not adequately output a steady flow of solid material. For example, existing liquid removal systems may be unable to remove liquid continuously from a solids flow fed between an upstream system and a downstream system. Furthermore, control of flow rates of the solids flow between upstream and downstream systems may be difficult with existing liquid removal sections, particularly those that handle the solids flow in batch mode.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a multi-feeder assembly. The multi-feeder assembly includes a first solids feeder, a liquid removal section, and a second solids feeder. The first solids feeder is configured to receive a solids flow from an upstream system. The liquid removal section is configured to reduce an amount of liquid in the solids flow. The second solids feeder is configured to receive the solids flow in series with the first solids feeder and output the solids flow to a downstream system.

In a second embodiment, a system includes a controller configured to control parameters of a multi-feeder assembly. The multi-feeder assembly includes a first solids feeder, a liquid removal section, and a second solids feeder. The parameters include a first feed rate of a solids flow through the first solids feeder and a second feed rate of the solids flow through the second solids feeder.

In a third embodiment, a method includes receiving a solids flow in a first solids feeder of a multi-feeder assembly. The method also includes reducing an amount of liquid in the solids flow with a liquid removal section of the multi-feeder assembly. In addition, the method includes modifying a pressure of the solids flow with a second solids feeder of the multi-feeder assembly.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
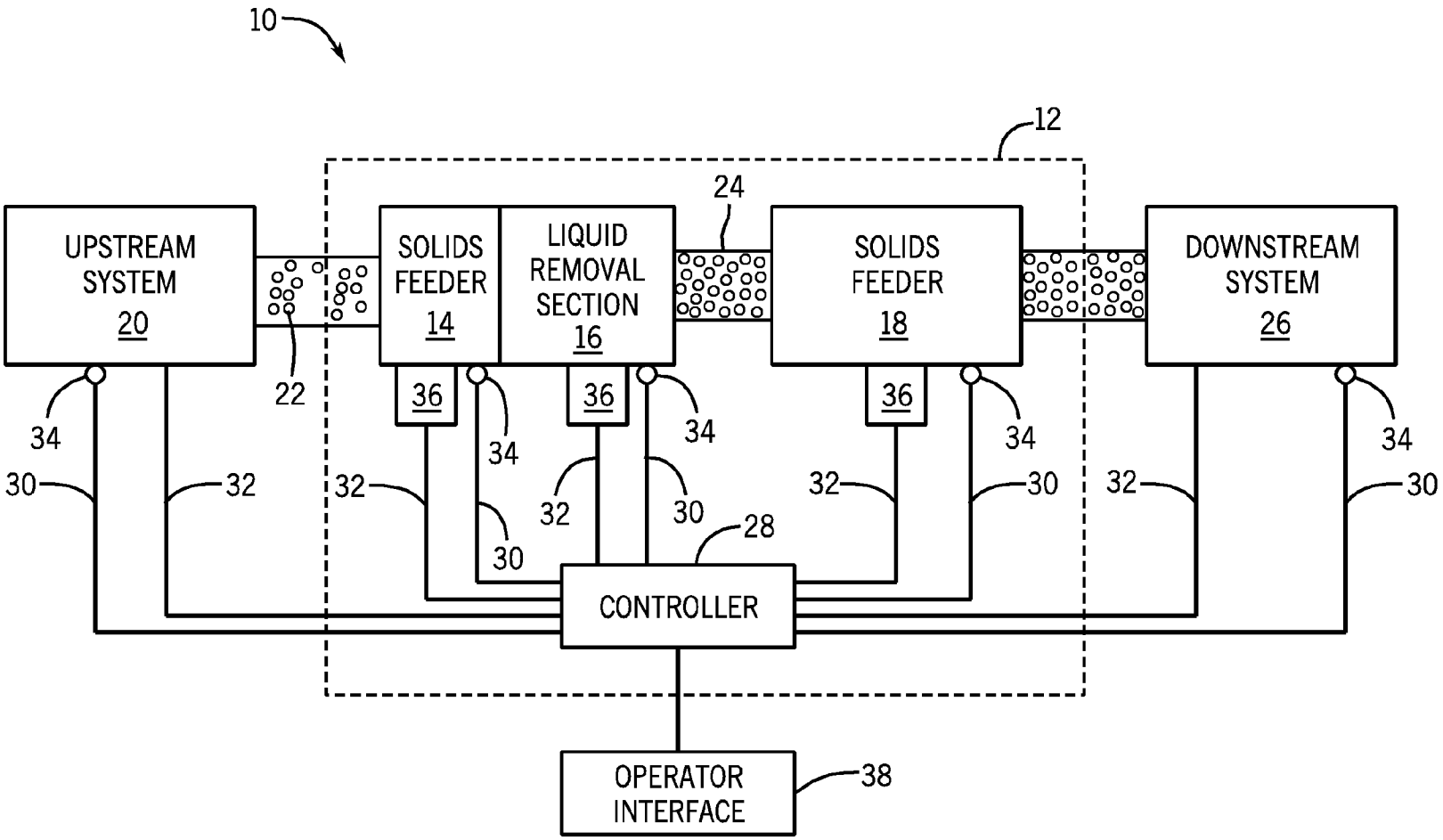
FIG. 1 is a schematic block diagram of an embodiment of a system having a multi-feeder assembly of two solids feeders and a dewatering section.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Presently contemplated embodiments are directed to systems and methods for removing liquid from a solids flow using a multi-feeder assembly. The solids flow may be an industrial waste or byproduct, such as a slag output from a gasifier. The solids flow also may be a carbonaceous feedstock supplied to a reactor, such as a gasifier, combustor, furnace, boiler, or other reaction chamber. The multi-feeder assembly includes a first solids feeder, a liquid removal section, and a second solids feeder. The multi-feeder assembly feeds the solids flow between an upstream system and a downstream system, and the liquid removal section reduces an amount of liquid in the solids flow. The second solids feeder may modify (e.g., reduce) a pressure of the solids flow as it feeds the solids flow toward the downstream system. A pressure reduction may be particularly beneficial for a high pressure upstream system, such as a gasifier, where it is desirable to reduce a pressure of slag output from the gasifier. The liquid removal section may be an inclined conduit containing a pressurized buffer gas that acts as a selective barrier to block passage of liquid, but allow passage of the solids flow. In some embodiments, the liquid removal section is located between (or within one of) the first and second solids feeders, which for example may be positive displacement pumps, screw feeders, or any combination thereof. In certain embodiments, the first solids feeder may be an inclined screw feeder that includes the liquid removal section. A controller may govern operation of the multi-feeder assembly, such as the feed rates of the first and second solids feeders, based on sensor feedback received from sensors located throughout the system. The multi-feeder assembly may continuously feed, remove liquid from, and modify a pressure of the solids flow.

Turning now to the drawings, FIG. 1 illustrates a block diagram of an embodiment of a system 10 having a multi-feeder assembly 12. The illustrated multi-feeder assembly 12 includes, among other things, a first solids feeder 14, a liquid removal section 16, and a second solids feeder 18. The first solids feeder 14 is coupled to an upstream system 20 (e.g., gasifier). As described herein, the term upstream may be a direction towards the source of a solids flow 22 (e.g., a flow of solid particulate), while downstream may be in a direction of the solids flow 22 passing through the system 10. The first solids feeder 14 is configured to receive the solids flow 22 from the upstream system 20. The solids flow 22 may have various compositions including, but not limited to, slag mixtures, fuels (e.g., coal), char, catalysts, plastics, chemicals, minerals, pharmaceuticals, and/or food products. The first solids feeder 14 feeds the solids flow 22 through the liquid removal section 16 (e.g., dewatering section). As described herein, the term dewatering section may represent a liquid removal section 16 used to reduce an amount of water (or other liquid) in the solids flow 22 passing through the multi-feeder assembly 12. The second solids feeder 18 is in series with the first solids feeder 14, and the multi-feeder assembly 12 may include a conduit 24 for routing the solids flow 22 from the first solids feeder 14 to the second solids feeder 18. The second solids feeder 18 is configured to receive the solids flow 22 and to output the solids flow 22 to a downstream system 26. As described in detail below, the liquid removal section 16 may reduce an amount of liquid in the solids flow 22 passing through the multi-feeder assembly 12 from the upstream system 20 to the downstream system 26.

The multi-feeder assembly 12 may include a controller 28 configured to monitor and control the operation of the entire system 10, or components of the system 10, through signal lines 30 and control lines 32. In some embodiments, one or more sensors 34 may transmit feedback from components of the system 10 to the controller 28 through the signal lines 30. The sensors 34 may detect or measure a variety of system and solids flow properties. Specifically, the sensors 34 may include but are not limited to flow sensors, void sensors, pressure sensors, differential pressure sensors, density sensors, level sensors, concentration sensors, composition sensors, or torque sensors, or combinations thereof. For example, the sensors 34 of the first and second solids feeders 14 and 18 may measure the respective first and second feed rates of the solids flow 22, and the sensors 34 of the liquid removal section 16 may measure a quantity of voids, a liquid level, or the density of the solids flow 22 through the liquid removal section 16. In addition, the sensors 34 of the upstream system 20, the liquid removal section 16, and the downstream system 26 may be pressure sensors used in combination to monitor pressure differentials between various components of the system 10. In addition, the controller 24 may receive inputs from the upstream and downstream systems 20 and 26 via the signal lines 30 for determining a desired feed speed for the solids feeders 14 and 18.

The controller 28 may control the operation of the components of the system 10 by controlling actuators 36. The actuators 36 may drive or actuate the components according to control signals sent via the control lines 32. In presently contemplated embodiments, the actuators 36 of the first and second solids feeders 14 and 18 may be electric or hydraulic motors configured to rotate an auger or screw feeder about an axis or to drive one or more positive displacement pumps. The actuator 36 of the liquid removal section 16 may include one or more valves for controlling a volume of pressurized buffer gas, wash liquid, or a combination thereof, in the liquid removal section 16. In some embodiments, the first and second solids feeders 14 and 18 may have a common actuator 36.

The controller is configured to control parameters of the multi-feeder assembly 12, and these parameters include a first feed rate of the solids flow 22 through the first solids feeder 14 and a second feed rate of the solids flow 22 through the second solids feeder 18. The controller 28 may control the operation of the first and second solids feeders 14 and 18 by adjusting the speed and/or torque of the one or more actuators 36. The controller 28 may control components of the system 10 based on sensor feedback from the one or more sensors 34. Specifically, the controller 28 may control the first and second feed rates of the solids flow 22 based at least in part on feedback indicative of a solids flow pressure, a quantity of voids, a buffer gas flow rate, a solids volume, a solids flow rate, or a torque. For example, the controller 28 may decrease the feed rates of the first and second solids feeders 14 and 18 when the amount of the solids flow 22 entering the first solids feeder 14 decreases. This decrease may be determined based on signals from one or more sensors 34 of the upstream system 20 (e.g., monitoring the flow rate of solids from the upstream system 20 toward the multi-feeder assembly 12). As a result, the controller may operate the first and second solids feeders 14 and 18 at a proper feed rate to maintain a desired solids lockup condition (described below) within the solids feeders 14 and 18. The controller 28 may adjust a valve position to change the flow rate of an inert buffer gas into the liquid removal section 16 based on the pressure of the solids flow 22 entering the liquid removal section 16. The first and second solids feeders 14 and 18, the liquid removal section 16, the controller 28, the sensors 34, and the actuators 36 may all be part of the multi-feeder assembly 12.

The controller 28 may be coupled to an operator interface 38 configured to receive operator input. Through the operator interface 38, an operator may configure the controller 28 to control how the multi-feeder assembly 12 conveys the solids flow 22 to the downstream system 26. Operator input received through the operator interface 38 may define acceptable variations in the feed rate to the downstream system, maximum feed rates or operating speeds, minimum feed rates or operating speeds, pressure parameters, levels, or combinations thereof. The operator interface 38 also may allow for monitoring of various properties of the solids flow 22 moving through the multi-feeder assembly 12. For example, the operator may monitor the multi-feeder assembly 12 as it conveys the solids flow 22 to the downstream system 26 within approximately 1%, 5% or 10% of a desired feed rate (e.g., the same feed rate the solids flow 22 is input to the multi-feeder assembly 12 or the same feed rate the solids flow 22 is input to the multi-feeder assembly minus a rate of water or liquid removed from the solids). In some embodiments, the operator interface 38 may enable direct control of the system 10 by the operator. Inputs received through the operator interface 38 may direct the controller 28 to adjust the solid feed rates of the first and second solids feeders 14 and 18 due to a scheduled interruption (e.g., transition) in the solids flow 22 supplied to the first solids feeder 14 by the upstream system 20. The operator interface 38 may also display information (e.g., sensor feedback) regarding the operation of the system 10 and/or multi-feeder assembly 12.

Some embodiments of the system 10 include a gasification system, which may include a gasifier as the upstream system 20. Gasification technology can convert hydrocarbon feedstocks, such as coal, biomass, and other carbonaceous feed sources, into a gaseous mixture of carbon monoxide (CO) and hydrogen ($H_2$), i.e., syngas, by reaction with oxygen and steam in a gasifier. These gases may be processed and utilized as fuel, as a source of starting materials for more complex chemicals or liquid fuels, for the production of substitute natural gas, for the production of hydrogen, or a combination thereof. The system 10 may be configured to pass the solids flow 22 between a gasifier and the multi-feeder assembly 12. In some embodiments, the upstream system 20 or downstream system 26 may be a gasification system coupled to the multi-feeder assembly 12. For example, the upstream system 20 may include a gasifier coupled to the multi-feeder assembly 12. More specifically, the upstream system 20 may include a quench chamber of a gasifier coupled with one or more slag crushers to prepare the solids flow 22 (e.g., slag mixture) for input into the multi-feeder assembly 12. The liquid removal section 16 may reduce an amount of liquid (e.g., water) that passes through the multi-feeder assembly 12 in order to dewater the solids flow 22 before outputting it to the downstream system 26 (e.g., a slag handling unit). However, the upstream system 20 may include a variety of reactors, such as the gasifier, a combustor, a furnace, a boiler, or any other industrial reactor unit that produces wet solids. In these embodiments, the downstream system 26 may include a solids processing system, such as a slag, waste, byproduct or final product processing system. In other embodiments, the upstream system 20 may include a feedstock processing system, while the downstream system 26 may include a reactor, such as the gasifier, a combustor, a boiler, a furnace, and so forth. The upstream system 20 and the downstream system 26 may be controlled by the controller 28. For example, the controller 28 may operate components of the upstream system 20 (e.g., slag crushers of a gasifier) to maintain relatively uniform properties (e.g., particle size distribution) of the solids flow 22 output to the first solids feeder 14. As described in detail below, the first solids feeder 14 may be a screw feeder, a drag conveyor, or a positive displacement pump. In certain embodiments described below, the liquid removal section 16 is disposed between the first and second solids feeders 14 and 18. In other embodiments, the first solids feeder 14 includes the liquid removal section 16, meaning that the first solids feeder 14 functions as a dewatering conveyor (e.g., drag conveyor, screw feeder, etc.).

Presently contemplated embodiments of the multi-feeder assembly 12 may enable a continuous process for dewatering and modifying a pressure of (e.g., depressurizing) the solids flow 22. That is, the multi-feeder assembly 12 may be used to continuously move the solids flow 22, remove the liquid from the solids flow 22, and depressurize the solids flow 22 between the upstream and downstream systems 20 and 26. This may be accomplished through the controller 28 controlling various parameters of the multi-feeder assembly 12. In some embodiments, the controller 28 may operate the multi-feeder assembly 12 to continuously flow and remove liquid from the solids flow 22, without depressurizing the solids flow 22. In other embodiments, the multi-feeder assembly may continuously direct the solids flow 22 between the upstream and downstream systems 20 and 26 operating with incompatible atmospheres. Continuous feeding of the solids flow 22 through the multi-feeder assembly 12 may offer significant improvements over other liquid removal systems and/or slag removal systems, specifically in terms of system dimensions and uniformity of the solids flow 22 output to the downstream system 26.

Figure 2:
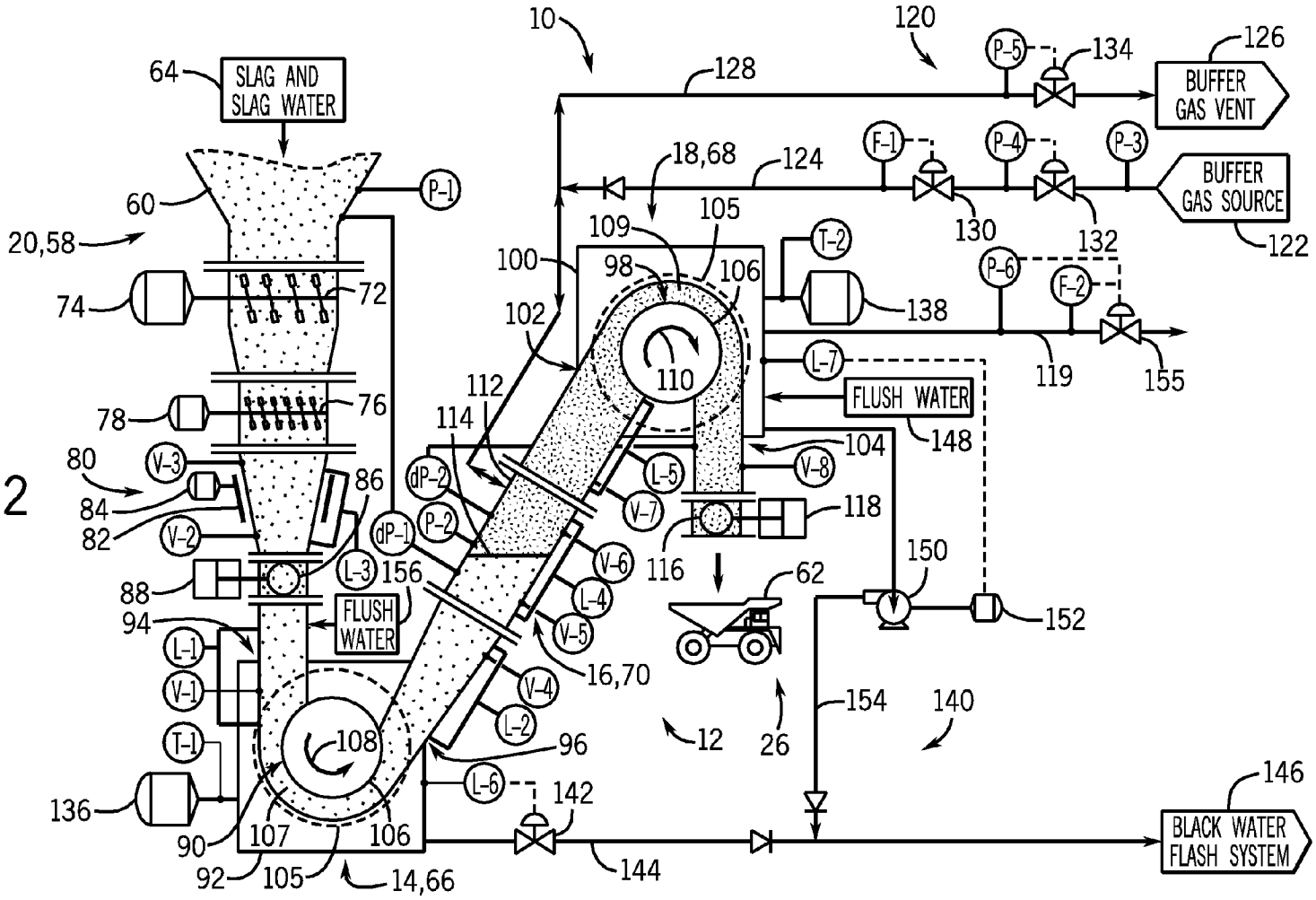
FIG. 2 is a schematic cross sectional view of an embodiment of the system of FIG. 1 having two positive displacement pumps and an inclined conduit.

FIG. 2 is a schematic cross sectional view of an embodiment of the system 10 of FIG. 1 using the multi-feeder assembly 12 for continuous slag removal from a gasifier 58. In the illustrated embodiment, the upstream system 20 includes a quench chamber 60 of the gasifier 58, and the downstream system 26 is a slag removal system 62 for collecting and transporting dewatered slag. The solids flow 22 through the multi-feeder assembly 12 enters as a slag mixture 64 of slag and slag water, which may be a wet ash material byproduct of a gasification process. The first solids feeder 14 includes a first positive displacement pump 66, the second solids feeder 18 includes a second positive displacement pump 68, and the liquid removal section 16 includes an inclined conduit 70 disposed between and coupled to the first and second positive displacement pumps 66 and 68. The inclined conduit 70 contains a pressurized buffer gas (e.g., an inert gas) to block passage of the liquid in the solids flow 22. The controller 28 of FIG. 1 may control the first solids feeder 14, the liquid removal section 16, and/or the second solids feeder 18 based on sensor feedback.

The upstream system 20 includes the quench chamber 60 of the gasifier 58, where solid slag is mixed with liquid to form the slag mixture 64. The liquid may be water used in the quench chamber 60 to cool the slag. The slag mixture 64 from the quench chamber 60 may pass through one or more optional slag crushers before entering the multi-feeder assembly 12. In the illustrated embodiment, the upstream system 20 includes a first slag crusher 72 driven by a motor 74 and a second slag crusher 76 driven by a motor 78. The first and second slag crushers 72 and 76 may each include one or more toothed rotors for breaking up relatively large slag particles in the slag mixture 64, although other types of slag crushers may be used. The first slag crusher 72 may provide coarse crushing of the slag mixture 64 in the quench chamber 60. The second slag crusher 76, located downstream of the first slag crusher 72, may provide fine crushing of the slag mixture 64. The first and second slag crushers 72 and 76 may crush the slag mixture 64 to establish a desired slag particle size distribution (PSD). This may be useful for enabling effective solids lockup of the solids flow 22 in the positive displacement pumps 66 and 68, as described in detail below. Although the quench chamber 60 may generally receive the slag mixture 64 from a gasification chamber in an appropriate PSD, the first and second slag crushers 72 and 76 may ensure the desired particle size distribution in the event that process upsets occur in the gasifier 58 upstream of the quench chamber 60. Downstream of the second slag crusher 76, the upstream system 20 may include a live wall hopper 80. The live wall hopper 80 is a funnel with walls 82 that are actuated by a vibrator 84, which may be an unbalanced motor, a pneumatic vibrator, or the like. As the live wall hopper 80 vibrates, any voids that may be found among the granular slag particles may be reduced or eliminated. This ensures that the crushed slag mixture completely fills the inlet to the first positive displacement pump 66 which, in turn, helps to ensure that the desired solids flow 22 is sent to the multi-feeder assembly 12. There may be a shutdown/backup valve 86 located downstream of the live wall hopper 80 to be used during startup, shutdown, and/or emergency response operations. The shutdown/backup valve 86 may be a ball valve operated by an actuator 88, and the controller 28 may control the actuator 88 based on sensor feedback from the system 10. For example, the controller 28 may maintain the shutdown/backup valve 86 in an open position during normal system operations and close the shutdown/backup valve 86 for isolating the quench chamber 60 after the gasifier 58 is shut down.

The first and second solids feeders 14 and 18 in the illustrated multi-feeder assembly 12 are positive displacement pumps. One or both of the positive displacement pumps 66 and 68 may be a Posimetric® Feeder made by General Electric Company of Schenectady, N.Y. The first and second positive displacement pumps 66 and 68 may be capable of continuously moving the solids flow 22 against a pressure gradient. As shown in FIG. 2, the first positive displacement pump 66 includes a first rotor 90 disposed in a first chamber 92 between a first inlet 94 and a first outlet 96. Similarly, the second positive displacement pump 68 includes a second rotor 98 disposed in a second chamber 100 between a second inlet 102 and a second outlet 104. Each of the first and second rotors 90 and 98 may include two substantially opposed and parallel rotary discs 105, separated by a hub 106 and joined to a shaft that is common to the parallel discs 105 and the hub 106. Note that, in FIG. 2, the two discs 105 are not in the plane of the page, as are the rest of the elements in the figure. One of the discs 105 is below the plane of the page, and the other is above the plane. The disc 105 below the plane is projected onto the plane of the page in order that it may be seen in relation to other components of the positive displacement pumps 66 and 68. The hub 106 may include an outer convex surface. In the first positive displacement pump 66, for example, the convex surface of the hub 106, the annular portions of both disks 105 extending between the convex surface of the hub 106 and the outer circumference of the discs 105, and an inner, concave surface of the first chamber 92 define an annularly shaped, rotating channel 107 that connects the first inlet 94 and the first outlet 96. A portion of the first chamber 92 disposed between the first inlet 94 and the first outlet 96 divides the rotating channel 107 in such a way that solids entering the first inlet 94 may travel only in a direction of rotation 108 of the first rotor 90, so that the solids may be carried from the first inlet 94 to the first outlet 96 by means of the rotating channel 107.

As the solids flow 22 enters and moves downward through the first inlet 94, the solid particles progressively compact. As the solid particles continue to be drawn downwards and into the rotating channel 107, the compaction may reach a point where the particles become interlocked and form a bridge across the entire cross-section of the rotating channel 107. As the compacted particles continue to move with the rotating channel 107 in the direction of rotation 108, the length of the zone containing particles which have formed an interlocking bridge across the entire cross-section of the rotating channel 107 may become long enough that the force required to dislodge the bridged particles from the rotating channel 107 exceeds the force that may be generated by the high pressure environment at the first outlet 96. This condition, where the interlocking solids within the rotating channel 107 cannot be dislodged by the high pressure at the first outlet 96, is called "lockup". By achieving the condition of lockup, the torque delivered by the shaft from a drive motor 136 may be transferred to the rotating solids so that the solids are driven from the first inlet 94 to the first outlet 96 against whatever pressure exists in the high-pressure environment beyond the first outlet 96. In some embodiments, the discs 105 may have raised or depressed surface features formed onto their surfaces. These features may enhance the ability of the particulate solids to achieve lockup in the rotating channel 107 and, therefore, may enhance the ability of the drive shaft to transfer torque to the rotating solids. The components of the second positive displacement pump 68 operate in the same way to convey the solids flow 22 through an annular rotating channel 109 of the second rotor 98 in a rotational direction 110. It should be noted that either, or both, of the first and second positive displacement pumps 66 and 68 may be configured to form a dynamic plug of the solids flow 22 moving through the multi-feeder assembly 12 (e.g., at or adjacent to the pump inlets or outlets) in order to block gas flow and/or liquid flow.

The first positive displacement pump 66 receives the solids flow 22 from the upstream system 20 (e.g., the live wall hopper 80) through the first inlet 94. It should be noted that the solids flow 22 entering the first positive displacement pump 66 includes a wet slag mixture, which has solid granular slag particles with liquid distributed between the particles. To feed the solids flow 22 through the liquid removal section 16, the first positive displacement pump 66 may slightly increase the pressure of the solids flow 22 as it is fed through the first positive displacement pump 66. This may be accomplished through proper shaping of the first outlet 96 of the first positive displacement pump 66 and by the application of a slightly higher pressure in the inclined conduit 70 downstream of the pump 66. For example, the geometry of the first outlet 96 may be designed in such a way that the solids flow 22 naturally compacts to the point where it sustains a stable pressure increase as the solids flow 22 moves from the first outlet 96 into the inclined conduit 70. Furthermore, the geometries of the first outlet 96 and of the inclined conduit 70 is designed in such a way that the motive force applied by the first positive displacement pump 66 is able to drive the solids flow 22 through the first outlet 96 as well as through the inclined conduit 70 and into the inlet 102 of the second positive displacement pump 68. In this way, the solids flow 22 may move through the inclined conduit 70 using a minimum force exerted on the solids flow 22 from the first positive displacement pump 66.

As previously mentioned, the illustrated liquid removal section 16 includes the inclined conduit 70, which may be a conduit for guiding the solids flow 22 between the first outlet 96 and the second inlet 102. The inclined conduit 70 may be inclined relative to a horizontal plane at an angle with the range of approximately 15-90 degrees, approximately 20-70 degrees, or approximately 30-60 degrees, or any suitable angle for conveying the solids flow 22 between the positive displacement pumps 66 and 68. The inclined conduit contains a fixed volume of pressurized buffer gas that defines a liquid/gas interface 114 between the gas, which fills the spaces between solid particles in the top portion of the inclined conduit 70, and the liquid, which fills the spaces between the solid particles in the bottom portion of the inclined conduit 70. The pressurized buffer gas may be carbon dioxide or nitrogen, or any suitable inert gas, supplied to the inclined conduit 70 at a desired pressure through a gas inlet 112. The pressurized buffer gas forms a selective barrier, defined by the location of the stationary liquid/gas interface 114, which blocks the advance of slag water while allowing the movement of dewatered slag upwards through the inclined conduit 70. Thus, by blocking the advance of liquid up the conduit 70 while permitting the advance of the flow of solids 22, the liquid removal section 16 reduces an amount of the water in the solids flow 22 passing between the first and second positive displacement pumps 66 and 68. The liquid removal section 16 may remove a certain amount of the liquid (e.g., water) from the solids flow 22. For example, in some embodiments, the liquid removal section 16 may be configured to remove all of the free flowing liquid from the solids flow 22, such that the only liquid remaining is the liquid internal to and/or on the surface of the solid particles. In other embodiments, the liquid removal section 16 may include a heated channel or receive a flow of heated buffer gas to facilitate the removal of water from the solids flow 22, including liquid on the surface or internal to the solid particles of the solids flow 22. In either case, the solids flow 22 received by the second positive displacement pump 68 is a dewatered slag.

The second positive displacement pump 68 may reduce the pressure of the received solids flow 22, possibly down to atmospheric pressure, before outputting the dewatered and depressurized solids flow 22 to the downstream system 26. In the illustrated embodiment, the downstream system 26 includes a slag removal system 62 (e.g., a vehicle) for moving the slag offsite. In other embodiments, the downstream system 26 may be a conveyor system for transporting the slag to another system in the gasification plant for additional processing. The multi-feeder assembly 12 may include a startup/safety valve 116 at the second outlet 104 of the second positive displacement pump 68 to be used for startup, shutdown, and/or emergency response operations. The startup/safety valve 116 may be a ball valve operated by an actuator 118, and the controller 28 may control the actuator 118 based on sensor feedback from the system 10. For example, the controller 28 may maintain the startup/safety valve 116 in an open position during normal system operations and close the startup/safety valve 116 for pressurizing or depressurizing the system 10 when the gasifier 58 is started or shut down, or in response to a process upset. The multi-feeder assembly 12 may further include a vent line 119 connected to a portion of system 10 downstream of the inlet 102 of the second positive displacement pump 68. The vent line 119 may be used with the controller 28 to prevent excessive pressure buildup within or downstream of the second positive displacement pump 68 when solids are flowing through second positive displacement pump 68 and the startup/safety valve 116 is in a closed position. Such may be the case during startup, shutdown, or when establishing a solids plug in the second positive displacement pump 68. The vent line 119 also may include a valves and sensors, described below, that can be used to confirm that a dynamic plug has been established, and for venting a portion of the system 10 downstream of the second positive displacement pump 68 before opening the startup/safety valve 116.)

As previously discussed with respect to FIG. 1, the system 10 includes sensors 34 for providing signals to the controller 28 to control the different actuators 36 of the multi-feeder assembly 12. The controller 28 controls the first and second feed rates of the solids flow 22 through the first and second positive displacement pumps 66 and 68 based on sensor feedback. For example, if the controller 28 receives sensor feedback that solids are beginning to become jammed inside the inclined conduit 70, the controller 28 may decrease the speed of the first positive displacement pump 66 or increase the speed of the second positive displacement pump 68 in order to alleviate the jam. Likewise, if the controller 28 receives sensor feedback that the gasifier is producing less slag, the controller 28 may reduce the speed of the positive displacement pumps 66 and 68 in order to avoid the generation of void spaces within the solids flow 22, as these could lead to the loss of the lockup condition in the positive displacement pumps 66 and 68. In addition, the controller 28 may control the supply of pressurized buffer gas to and/or removal of gas from the liquid removal section 16 in order to maintain the liquid/gas interface 114 in a stationary position within the inclined conduit 70 based on sensor feedback. The sensor feedback collected by the sensors 34, may include feedback indicative of a solids flow pressure, a differential pressure, a quantity of voids, a buffer gas pressure, a buffer gas supply flow rate, a buffer gas vent flow rate, a solids flow volume, a solid level, a liquid level, or a torque.

FIG. 2 shows an exemplary arrangement of the sensors 34 located throughout the system 10. Different numbers and arrangements of the sensors 34 may be possible. In the illustrated embodiments, the sensors 34 include level sensors L-1, L-2, L-3, L-4, L-5, L-6, and L-7 that detect a level of liquid in the solids flow 22 through different sections of the system 10. The sensors 34 also may include void sensors V-1, V-2, V-3, V-4, V-5, V6, V-7, and V-8 that detect a volume of the solids flow 22, or spaces in the otherwise continuous column of the packed solids flow 22, moving through the multi-feeder assembly 12. The void sensors may be relatively complex sensors, each including multiple sensors that work together to detect the presence or absence of solid slag particles. In addition, the sensors 34 may include a flow sensor F-1 for monitoring a buffer gas flow rate of the pressurized buffer gas. The vent line 119 may include a flow sensor F-2 to monitor a flow of gases that are vented from the system 10. The sensors 34 also may include pressure sensors P-1, P-2, P-3, P-4, P-5, and P-6 for sensing the pressure of the solids flow 22 and/or gases for maintaining a desired pressurization of fluids in the system 10. Differential pressure sensor dP-1 may monitor a difference in pressure between the upstream system 20 and the multi-feeder assembly 12, and dP-2 may monitor a difference in pressure between the multi-feeder assembly 12 and the downstream system 26. Further, torque sensors T-1 and T-2 may monitor the torque applied to the first and second rotors 90 and 98, respectively. Based on feedback from the various sensors 34, the controller 28 may operate the different actuators 36 of the system 10 to control the solids flow 22 through the multi-feeder assembly 12 and to maintain the liquid/gas interface 114 substantially in a fixed location within the inclined conduit 70.

The first positive displacement pump 66 may increase the pressure of the solids flow 22 just enough to maintain the dynamic solids lockup condition of the solids flow 22 in the first positive displacement pump 66. Although the solids flow 22 may pass from the gasifier 58 to the multi-feeder assembly 12 at a relatively high gasifier pressure, e.g., within a range of 2 to 10, 3 to 8, 3.5 to 5, or approximately 4.5 MPa, the first positive displacement pump 66 may not feed the solids flow 22 through a significant pressure increase at all. The first solids feeder 14 may increase the pressure of the solids flow 22 by approximately 0, 0.2, 0.5, 0.7, or 1.0 MPa, or more. The pressure increase may be just enough to feed the solids flow 22 through the first positive displacement pump 66 and up the inclined conduit 70 without forming a highly flow resistant plug in the first outlet 96. Thus, the pressure increase may be sufficient for moving the solids flow 22 up the inclined conduit 70 while allowing a backward flow of slag water relative to the slag particles of the solids flow 22. The first rotor 90 moves the solids flow 22 in the downstream direction, and the stationary volume of pressurized buffer gas blocks water from passing across the liquid/gas interface 114. The liquid/gas interface 114 is a wet/dry interface for the solids flow 22 through the multi-feeder assembly 12. That is, the solids flow 22 includes the slag mixture 64 of slag and water below (e.g., upstream of) the liquid/gas interface 114, and the solids flow 22 includes dewatered slag above (e.g., downstream of) the liquid/gas interface 114. The slag water, blocked by the pressurized buffer gas, flows backward relative to the forward motion of the solids flow 22 through the inclined conduit 70. It may be desirable for the water blocked by the pressurized buffer gas to flow back through the first positive displacement pump 66 at the same flow rate as the slag water that is drawn into the multi-feeder assembly 12 from the quench chamber 60. This may minimize a net flow of slag water through the multi-feeder assembly 12.

The illustrated system 10 includes a buffer gas handling system 120 coupled to the multi-feeder assembly 12 and configured to maintain the desired fixed volume of the pressurized buffer gas in the inclined conduit 70. More specifically, the buffer gas handling system 120 supplies the pressurized buffer gas (e.g., inert gas) from a buffer gas source 122 to the inclined conduit 70 via a supply line 124. The buffer gas handling system 120 may vent a portion of the buffer gas from the inclined conduit 70 to a buffer gas vent 126 via a vent line 128. It may be desirable to maintain the liquid/gas interface 114 at a relatively central position within the inclined conduit 70. The controller 28 may operate various control devices based on sensor feedback to maintain the desired pressure and volume of buffer gas in the inclined conduit 70. These control devices may include a flow control valve 130 coupled with the flow sensor F-1 along the supply line 124, a pressure control valve 132 coupled with the pressure sensor P-4 along the supply line 124, and a pressure control valve 134 coupled with the pressure sensor P-5 along the vent line 128. Although the illustrated embodiment includes the flow control valve 130 along the supply line 124, other embodiments may include a flow control valve along the vent line 128 in addition to, or in lieu of, the control valve 130. In this way, the controller 28 may control the supply of buffer gas to the inclined conduit 70 directly, by controlling the flow of buffer gas through the supply line 124, or indirectly, by controlling the flow of gas out through the vent line 128. The controller 28 may operate these devices based on sensor feedback from level sensors and pressure sensors throughout the system 10 to maintain the level of the liquid/gas interface 114 approximately in the middle of the inclined conduit 70. If the level of the liquid/gas interface 114 begins to rise, the controller 28 may increase the flow rate of the buffer gas through the supply line 124 to return the liquid/gas interface 114 to the desired level. If the level of the liquid/gas interface 114 begins to fall, however, the controller 28 may vent a portion of the buffer gas through the vent line 128 to enable the pressure from the upstream system 20 to raise the liquid/gas interface 114 to the desired level. In some embodiments, a portion of the buffer gas may exit the inclined conduit 70 with the solids flow 22 through the second positive displacement pump 68, creating a constant leak of the pressurized buffer gas from the liquid removal section 16. To accommodate this leak, the buffer gas handling system 120 may supply at least a positive flow (e.g., variable or constant) of the pressurized buffer gas into the inclined conduit 70.

The pressure of the pressurized buffer gas supplied to the inclined conduit 70 may be approximately equal to the pressure of the upstream system 20 added to the static head of the fluid contained upstream of the liquid/gas interface 114. This pressure may be equal to the pressure of the solids flow 22 exiting the first positive displacement pump 66. It should be noted that the buffer gas may be introduced to the multi-feeder assembly 12 at locations other than the illustrated gas inlet 112 in the inclined conduit 70. For example, the buffer gas may be supplied to the inclined conduit 70 through an inlet in a body of the first solids feeder 14 or second solids feeder 18, instead of directly into the inclined conduit 70. In some embodiments, the buffer gas handling system 120 may include a gas composition analyzer along the vent line 128 for determining a composition of gas (e.g., buffer gas and any other residual gases) vented from the inclined conduit 70. The results may be used to control the composition of the vented gas by adjusting a buffer gas pressure or a buffer gas flow.

The second positive displacement pump 68 is configured to receive the solids flow 22 and output the solids flow 22 to the downstream system 26. Before outputting the solids flow 22, however, the second positive displacement pump 68 may reduce a pressure of the solids flow 22. The illustrated second positive displacement pump 68 is configured to handle dewatered slag received from the inclined conduit 70 and reduce the pressure of the solids flow 22 from a maximum operating pressure to atmospheric pressure. The second inlet 102 may be properly shaped to promote the formation of a gas flow-resistant dynamic plug of the solids flow 22 moving through the second positive displacement pump 68 in order to reduce the amount of pressurized buffer gas that leaks out through the second positive displacement pump 68.

In the multi-feeder assembly 12 of FIG. 2, the actuators 36 of the first and second positive displacement pumps 66 and 68 include a first drive motor 136 for rotating the first rotor 90 and a second drive motor 138 for rotating the second rotor 98. In some embodiments, the first and second rotors 90 and 98 may be keyed together to rotate at the same solid feed rate. This may reduce the possibility of jams and voids within the solids flow 22 moving between the first and second positive displacement pumps 66 and 68. It may be useful, however, for the controller 28 to exercise independent control of the first and second drive motors 136 and 138. That is, feedback received from the void sensors V-4, V-5, V-6, and V-7 and the level sensors L-2, L-4, and L-5 may signal the controller 28 in response to a jam, or voids, in the solids flow 22 through the inclined conduit 70. In response, the controller 28 adjusts the speed of one or both of the drive motors 136 and 138 to reestablish the desired solids flow 22.

The multi-feeder assembly 12 may include a fines water handling system 140 to remove fines that leak through seals in the first and second positive displacement pumps 66 and 68. The term fines generally refers to fine solid particulate within the solids flow 22. In the first positive displacement pump 66, a mixture of fines and slag water may leak into the first chamber 92. The first chamber 92 is maintained at a relatively high pressure so that the fines water can be routed from the first chamber 92 via a control valve 142 into a first fines removal line 144. The first fines removal line 144 conveys the pressurized fines water to a black water flash system 146 in the gasification plant. In the second positive displacement pump 68, fines may leak into the second chamber 100. A flush water supply 148 may provide water to flush the fines away from the second chamber 100 and toward a pump 150. The pump 150 may be operated by a motor 152, based on signals from the level sensor L-7 in the second chamber 100, to pump the fines and flush water through a second fines removal line 154 leading to the black water flash system 146. It should be noted that the water used to carry the fines to the black water flash system 146, whether from the quench chamber 60 or from the flush water supply 148, is contained in liquid lines of the system 10. This may keep the fines water from being exposed to oxygen in the air outside of the system 10.

The controller 28 may be configured to execute a specific startup procedure for preparing the multi-feeder assembly 12 for continuous and simultaneous slag removal, dewatering, and depressurization. Although different startup procedures may be utilized, the following startup procedure may be used with the multi-feeder assembly 12 illustrated in FIG. 2.

First, each of the motors 74, 78, 84, 136, 138, and 152 are turned off, and the startup/safety valve 116 is positioned by the actuator 118 into an open position. The controller 28 establishes a normal operating pressure (P-3) for the pressurized buffer gas of the buffer gas source 122 and sets initial control pressures (P-4, P-5, and P6) of the buffer gas in the supply line 124 and the vent lines 128 and 119. After the buffer gas flows through the multi-feeder assembly 12 to purge the system 10 of air, the controller 28 operates the actuator 118 to close the startup/safety valve 116. This may increase the operating pressure throughout the system 10. The system 10 begins filling the quench chamber 60 with water. At this point, the shutdown/backup valve 86 may be open, such that the water flows from the quench chamber 60 into the multi-feeder assembly 12. As the water level increases within the system 10, the level sensors L-1, L-2, L-3, and L-4 monitor the progress of the water toward the middle of the inclined conduit 70. The controller 28 adjusts the pressure control valves 132 and 134, the flow control valve 130 of the pressurized buffer gas, and the control valve 155 to maintain the liquid/gas interface 114 in the middle of the inclined conduit 70. The controller 28 makes these adjustments based in part on feedback from the level sensor L-4, the pressure sensors P-1, P-2, and P-6, and the differential pressure sensor dP-1. Thus, the controller 28 maintains the proper level of the liquid/gas interface 114 as the quench chamber 60 fills with water, as the gasifier 58 preheats and as the gasifier pressure increases during gasifier startup. For example, as the gasifier pressure increases, the controller 28 may increase the pressure of the buffer gas flowing into the inclined conduit 70 to maintain the liquid/gas interface 114 at the desired level.

As the slag mixture 64 enters the multi-feeder assembly 12 from the quench chamber 60, the void sensors V-1, V-2, and V-3 detect a buildup of the slag mixture 64 upstream of the first positive displacement pump 66. When the first inlet 94 and the live wall hopper 80 are filled with the slag mixture 64, as detected by the void sensors, the controller 28 turns on the first drive motor 136 of the first positive displacement pump 66. This causes the first positive displacement pump 66 to begin feeding the solids flow 22 toward the inclined conduit 70. The controller 28 may control the feed rate of the solids flow 22 through the first positive displacement pump 66 based on sensor feedback indicative of the solid flow rate of the slag mixture 64 exiting the gasifier 58. The torque on the first drive motor 136 increases as the first positive displacement pump 66 begins feeding the solids flow 22 because of the solid particulate dynamically locking up in the first rotor 90. The torque increase is monitored by the torque sensor T-1, and the controller 28 may sound an alarm and/or take remedial action if an expected torque increase is not detected. For example, the controller 28 may operate the first positive displacement pump 66 in reverse for a short period of time, increase the vibration of the walls 82 of the live wall hopper 80, or raise the level of the liquid/gas interface 114 within the inclined conduit 70 to establish the desired solids lockup condition within the first inlet 94 of the first positive displacement pump 66.

As the solids flow 22 crosses the liquid/gas interface 114 in the inclined conduit 70, certain packing characteristics of the solids flow 22 may allow water to flow past a target location of the liquid/gas interface 114 between the solid particles of the solids flow 22. In such instances, the level sensor L-4 detects the changing level of the water flowing through the multi-feeder assembly 12, and the controller 28 responds by increasing the flow rate of the pressurized buffer gas flowing through the supply line 124. The increased pressure of the buffer gas in the inclined conduit 70 forces the water away from the solids flow 22 and back toward the first positive displacement pump 66.

As the solids flow 22 moves past the liquid/gas interface 114, the void sensor V-7 detects the presence of dewatered slag in the second inlet 102. In response, the controller 28 turns on the second drive motor 138 to turn the second rotor 98 of the second positive displacement pump 68. The solids flow 22 traveling therethrough forms a dynamic solids plug in the second positive displacement pump 68. As the solids flow 22 moves into the second positive displacement pump 68, the torque sensor T-2 detects a torque increase, the pressure sensor P-6 detects a pressure increase, or some combination thereof. This indicates that the solids flow 22 is in a desired dynamic solids lockup condition in the second positive displacement pump 68. In response, the controller 28 may open a control valve 155 of the vent line 119 to maintain the pressure P-6 at the same or a lower pressure than a portion of the system 10 upstream of the second positive displacement pump 68, such as a pressure in the inclined conduit 70. As before, if the desired torque increase is not detected, or the pressure detected by the pressure sensor P-6 becomes too high, the controller 28 may sound an alarm and/or take remedial action. As the second positive displacement pump 68 advances the solids flow 22, the void sensor V-8 detects the presence of the dewatered and depressurized solids flow 22 in the second outlet 104. In response, the controller 28 may operate the control valve 155 to reduce the pressure in the portion of system 10 between the second positive displacement pump 68 and the startup/safety valve 116. This may confirm the integrity of the solids plug in the inlet 102 of the second positive displacement pump 68 and reduce the pressure differential across the startup/safety valve 116. The controller 28 may then open the startup/safety valve 116, allowing the solids flow 22 to exit the multi-feeder assembly 12 toward the downstream system 26. As the multi-feeder assembly 12 continues to operate, the controller 28 adjusts the feed rates of the first and second positive displacement pumps 66 and 68 in response to sensed changes in gasifier throughput (e.g., solids flow rate from the gasifier 58). In addition, the controller 28 adjusts the pressure and flow rate of the pressurized buffer gas in the inclined conduit 70 based on sensed changes in gasifier pressure.

The controller 28 also may follow a specific procedure for shutting down the multi-feeder assembly 12 and returning the system 10 to an empty and depressurized state. As long as the void sensors V-1, V-2, and V-3 continue to detect the solids flow 22 through the multi-feeder assembly 12, the controller 28 maintains operation of the multi-feeder assembly 12. The gasifier pressure decreases as a part of the gasifier shutdown process, and this is detected by the pressure sensors P-1 and dP-1. In response, the controller 28 adjusts the pressure control valves 132 and 134 to maintain the liquid/gas interface 114 in the middle of the inclined conduit 70. As the gasifier 58 shuts down, the slag mixture 64 gradually stops flowing into the multi-feeder assembly 12; this is detected by the void sensors V-3, V-2, and finally V-1. Once the void sensor V-1 ceases to detect the solids flow 22, the controller 28 turns off the drive motors 136 and 138 of both of the positive displacement pumps 66 and 68. The controller 28 then closes the shutdown/backup valve 86 and depressurizes the multi-feeder assembly 12 by venting the buffer gas through the pressure control valve 134. This may unload the pressure difference maintained across the plug in the second positive displacement pump 68. The controller 28 runs the first and second positive displacement pumps 66 and 68 backwards for a period of time to remove any remaining plugs from either of the positive displacement pumps 66 and 68. A basin or container may be placed beneath the startup/safety valve 116, and a flush water supply 156 located upstream of the first positive displacement pump 66 may flush the multi-feeder assembly 12 with water, removing any residual solid particles from the multi-feeder assembly 12. Any remaining flush water may then be drained from the system 10.

The controller 28 may be configured to respond to a sudden and undesired loss of the pressure seal formed by the plug in the second positive displacement pump 68 during system operations. This may be referred to as the controller 28 operating in a pressure loss mode. Such a condition of the multi-feeder assembly 12 is immediately detected by the differential pressure sensor dP-2. In addition, the pressure sensor P-2 and the level sensors L-4 and L-5 may detect a change in pressure and movement of water through the multi-feeder assembly 12. In response, the controller 28 closes at least one of the startup/safety valve 116 and the shutdown/backup valve 86. The system 10 may then be shut down, or the issue may be diagnosed and repaired.

The procedures for system startup, shutdown, and response to pressure loss, as described in detail above, are representative, showing one way of operating the illustrated embodiment of the multi-feeder assembly 12. Indeed, the steps of the procedures shown above may be applied in different orders for some embodiments, and in other embodiments certain of the steps may be left out entirely. As mentioned before, embodiments of the multi-feeder system 12 may include different numbers and arrangements of the different sensors 34 located throughout the system 10. In such embodiments, the controller 28 may execute different startup and/or shutdown procedures to operate the system 10. Still, other embodiments may employ different configurations of the multi-feeder assembly 12, while having the same layout of the sensors 34, such that the controller 28 may execute similar procedures during system startup and/or shutdown.

Figure 3:
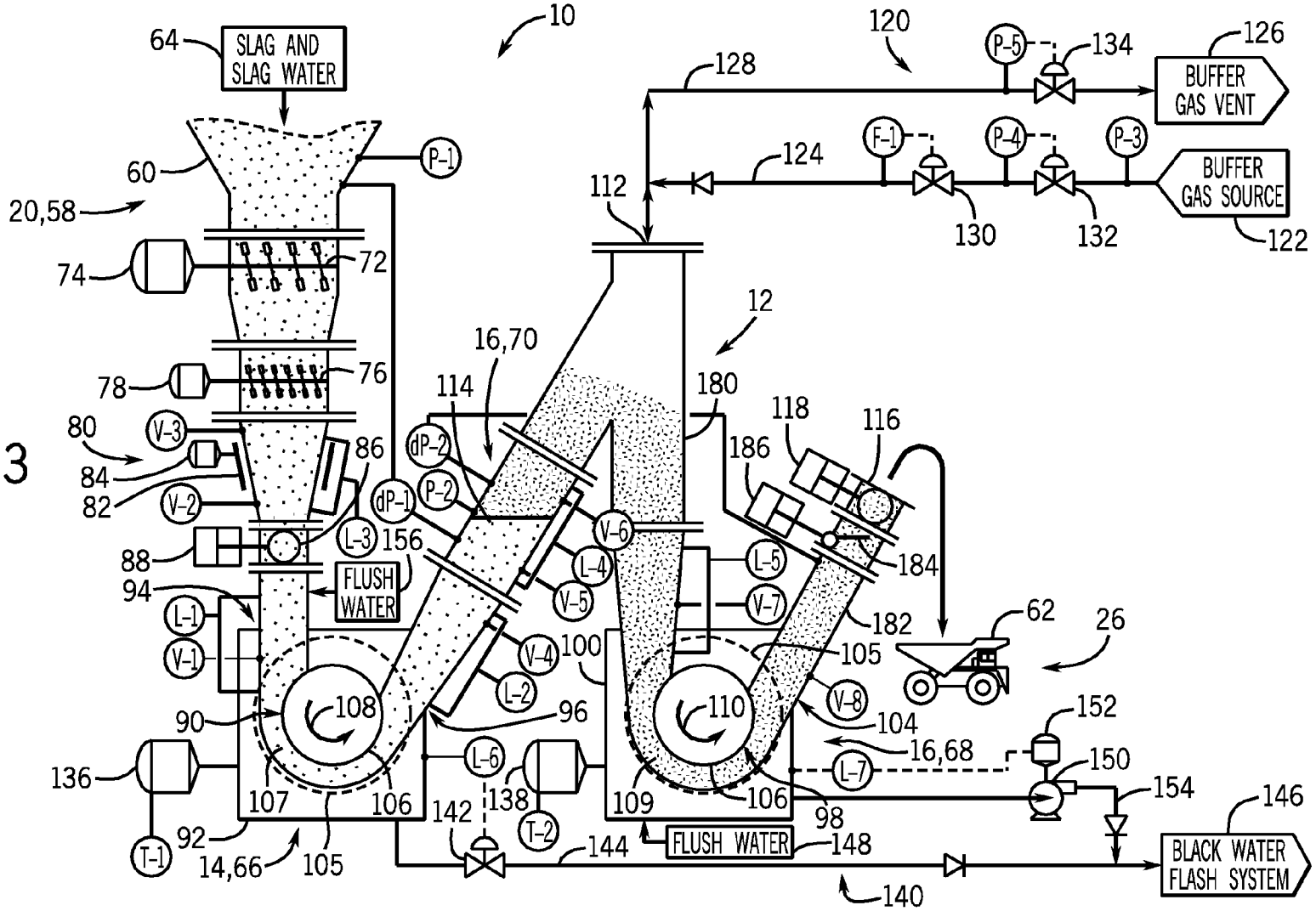
FIG. 3 is a schematic cross sectional view of an embodiment of the system of FIG. 1 having two positive displacement pumps and an inclined conduit.

FIG. 3 is a schematic cross sectional view of another embodiment of the system 10 of FIG. 1 having the multi-feeder assembly 12 for continuous slag dewatering. The illustrated multi-feeder assembly 12, like that of FIG. 2, includes the two positive displacement pumps 66 and 68 coupled to either side of the inclined conduit 70. In the illustrated embodiment, however, the solids flow 22 enters the second inlet 102 from above rather than from below. This may be desirable for forming a dynamic plug of the solids flow 22 entering the second positive displacement pump 68. As previously discussed, a plug of the solids flow 22 allows the second positive displacement pump 68 to feed the solids flow 22 through a pressure drop, from a relatively high operating pressure to atmospheric pressure. To establish the desired dynamic plug, the multi-feeder assembly 12 may include a vertical conduit 180 between the inclined conduit 70 and the second positive displacement pump 68, and the second positive displacement pump 68 may have a converging second inlet 102. Gravity exerts a force on the dewatered solids flow 22 exiting the liquid removal section 16, pulling the solid particles of the solids flow 22 down the vertical conduit 180, forming a dynamic plug at the converging second inlet 102 and achieving solids lockup in the rotating channel 109. The solids lockup condition provides resistance needed to maintain the desired dynamic plug in the second inlet 102, forming a separation between the solids flow 22 entering the second positive displacement pump 68 at the upstream system pressure and the solids flow 22 exiting the second positive displacement pump 68 at the downstream system pressure.

In FIG. 3, the first and second positive displacement pumps 66 and 68 are both located at a generally low vertical placement within the system 10. In order to output the solids flow 22 of dewatered and depressurized slag to the downstream system 26 (e.g., slag removal system 62), the multi-feeder assembly 12 may include a second inclined conduit 182 located between the second outlet 104 of the second positive displacement pump 68 and the downstream system 26. The second inclined conduit 182 may be angled approximately 15-90 degrees, approximately 20-70 degrees, or approximately 30-60 degrees relative to the horizontal plane. This allows the second inclined conduit 182 to convey the solids flow 22 to a desired height above the downstream system 26 so that the solids flow 22 may be output to the downstream system 26 under a gravitational force. The second inclined conduit 182 also may be beneficial for helping to form a dynamic solids plug at the second outlet 104 of the second positive displacement pump 68. It may be desirable to include a backpressure valve 184 downstream of the second positive displacement pump 68. The backpressure valve 184 may be a flap gate valve or some other valve suitable for applying a backpressure to the solids flow 22 traveling up the second inclined conduit 182. The controller 28 may operate an actuator 186 to adjust the position of the backpressure valve 184 to maintain a desired backpressure on the solids flow 22 during operation of the multi-feeder assembly 12. The backpressure placed on the solids flow 22 may help maintain the dynamic plug formed by the solids flow 22 within the second inclined conduit 182 and toward the downstream system 26.

It should be noted that the sensors 34 located throughout the illustrated embodiment of the system 10 are arranged similarly to those in FIG. 2. The controller 28 may operate the multi-feeder assembly 12 based on sensor feedback from these sensors 34. The controller 28 also may execute the previously described procedures for startup, shutdown, and response to pressure loss in the illustrated embodiment.

Figure 4:
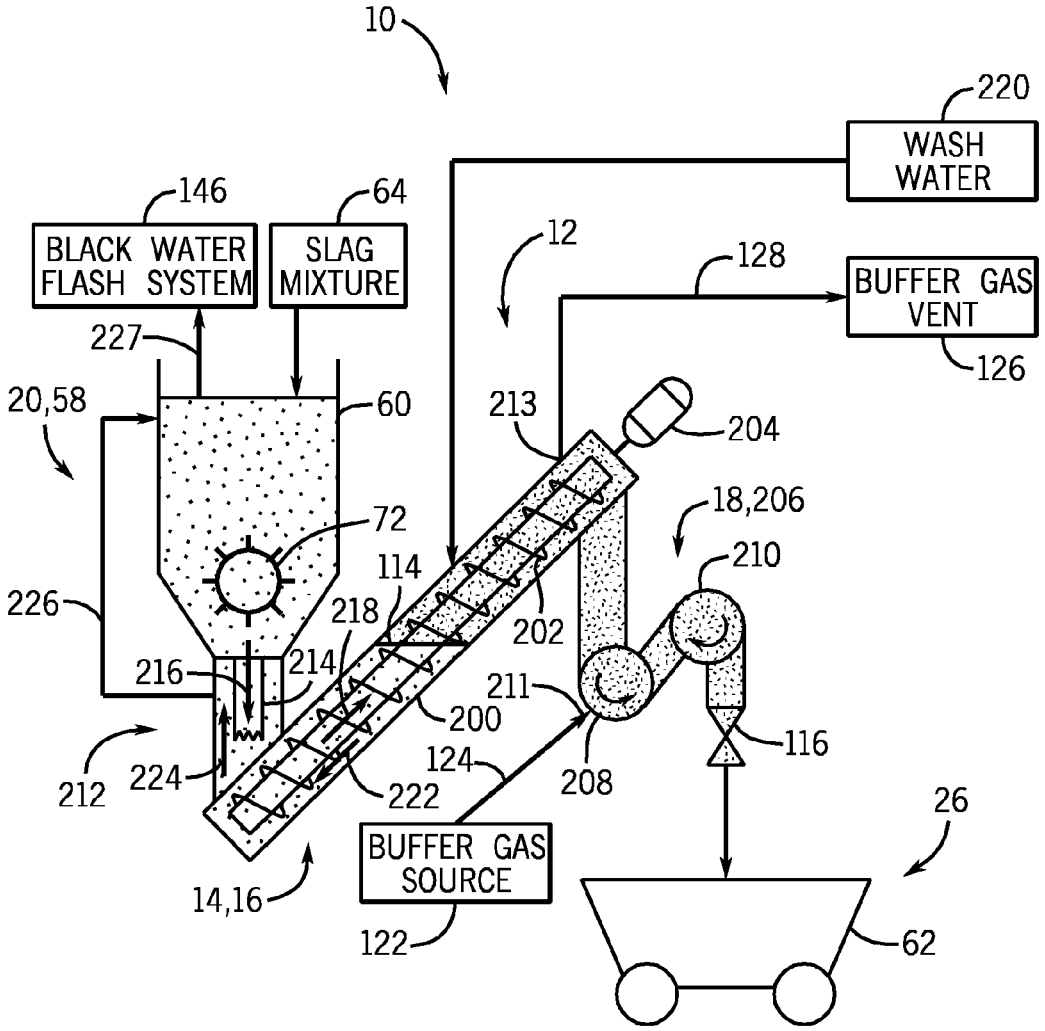
FIG. 4 is a schematic cross sectional view of an embodiment of the system of FIG. 1 having an inclined screw feeder and a multi-stage solids feeder.

FIG. 4 is a schematic cross sectional view of an embodiment of the system 10 of FIG. 1 having the multi-feeder assembly 12 for continuous slag dewatering and depressurization. In this embodiment, the first solids feeder 14 includes the liquid removal section 16. Specifically, the first solids feeder 14 is a screw feeder 200 that simultaneously acts as the first solids feeder 14 to receive the solids flow 22 from the upstream system 20 and as the liquid removal section 16 for reducing an amount of liquid (e.g., water) in the solids flow 22. The screw feeder 200 includes a screw 202 or auger that is driven to rotate by a motor drive 204 in order to feed the solids flow 22 through the screw feeder 200. The illustrated screw feeder 200 is oriented at an incline, and contains pressurized buffer gas (e.g., an inert gas) for blocking the flow of liquid up the screw feeder 200. The screw feeder 200 may be oriented at an angle of approximately 15-90 degrees, approximately 20-70 degrees, or approximately 30-60 degrees relative to the horizontal plane. As discussed above, the pressurized buffer gas may establish a selective barrier, defined by the liquid/gas interface 114, which enables flow of the solid slag particles while blocking flow of the liquid.

In the illustrated embodiment, the second solids feeder 18 is a multi-stage solids feeder 206 for reducing the pressure of the solids flow 22 from a high operating pressure (e.g., gasifier pressure) to atmospheric pressure. In other embodiments, however, the second solids feeder 18 may be a single stage solids feeder (e.g., positive displacement pump) or any other suitable device for modifying the pressure of the solids flow 22 passing therethrough. The multi-stage solids feeder 206 may include a first positive displacement pump 208 and a second positive displacement pump 210. Using the two positive displacement pumps 208 and 210 relatively close together and in series may allow the formation of multiple dynamic plugs of the solids flow 22 moving through the multi-stage solids feeder 206. For example, this may enable formation of a more robust seal between the solids flow 22 at the relatively high pressure of the gasifier 58 and the solids flow 22 at the lower pressure of the downstream system 26.

As before, the pressurized buffer gas is provided to the liquid removal section 16 by the buffer gas source 122. The buffer gas source 122 may introduce the buffer gas to the multi-feeder assembly 12 at the multi-stage solids feeder 206 via the supply line 124, as illustrated. The buffer gas vent 126 of the multi-feeder assembly 12 may receive pressurized buffer gas that is vented from the screw feeder 200 via the vent line 128. As depicted, the vent line 128 may be separate from the supply line 124, allowing the same or a different pressurized buffer gas to enter the multi-feeder assembly 12 at one position (e.g., gas inlet 211) and to exit the multi-feeder assembly 12 at another position (e.g., vent 213). It may be desirable to introduce the buffer gas at the multi-stage solids feeder 206, for example, to help establish a dynamic gas seal working with one or more dynamic plugs of the solids flow 22 through the multi-stage solids feeder 206. Again, the dynamic plug includes a moving compaction of solid particulate, which may substantially block fluid flow (e.g., gas and/or liquid flow). The buffer gas helps to further block fluid flow while enabling the solids flow 22. The multi-stage solids feeder 206 may include at least one additional vent for venting depressurized buffer gas that flows through the first positive displacement pump 208 of the multi-stage solids feeder 206. In some embodiments, at least a portion of the multi-stage solids feeder 206 may be operated under vacuum to reduce a discharge of gases from the outlet of multi-stage solids feeder 206.

The illustrated multi-feeder assembly 12 is configured to receive the solids flow 22 from the upstream system 20 into the screw feeder 200, reduce an amount of liquid in the solids flow 22, and output the solids flow to the downstream system 26. The multi-feeder assembly 12 includes a solids feeder inlet 212 that allows the solids flow 22 to enter the screw feeder 200 and the liquid (e.g., slag water) removed from the solids flow 22 to exit the screw feeder 200, as described below. In the illustrated embodiment, the solids flow 22 enters the multi-feeder assembly 12 as a slag mixture 64 from the quench chamber 60 of a gasifier 58. The slag mixture 64 flows through a quench chamber outlet 214 into the solids feeder inlet 212, as shown by an arrow 216. The screw feeder 200 receives the solids flow 22 (e.g., slag mixture 64) onto the screw 202 from the solids feeder inlet 212. The drive motor 204 rotates the screw 202 to communicate the solids flow 22 up the screw feeder 200, as indicated by arrow 218. An optional wash water supply 220 may provide a steady flow of water into the screw feeder 200 for at least partially washing the solids flow 22 as it moves up the screw feeder 200. The screw feeder 200 continues to feed the solids flow 22 across the liquid/gas interface 114 formed by the volume of pressurized buffer gas in the screw feeder 200. The liquid/gas interface 114 may permit the passage of the solids flow 22 and block the passage of liquid, such that the solids flow 22 becomes a dewatered slag after passing through the liquid/gas interface 114. The solids flow 22 continues into the multi-stage solids feeder 206, which may adjust the pressure of the solids flow 22 before outputting the solids flow 22 to the downstream system 26.

As previously mentioned, the screw feeder 200 acts as the liquid removal section 16 insofar as the pressurized buffer gas contained in the screw feeder 200 reduces an amount of the liquid in the solids flow 22 as the solids flow 22 moves through the screw feeder 200. The liquid that is removed from the solids flow 22 may be slag water, or water containing fines from the slag mixture 64. Fines may be solid particles of the slag that are too small to bind effectively with granular slag particles, and instead are easily washed away in the water. For example, the fines may be sized less than approximately 200 microns, less than approximately 100 microns, or less than approximately 50 microns in diameter, while the granular slag that exits the multi-feeder assembly 12 may be sized within a range of approximately 100 microns to 5 mm in diameter. The fines water that does not cross the liquid/gas interface 114 may wash back through the screw feeder 200, as indicated by arrow 222, toward the solids feeder inlet 212. From here, the fines water may flow upward through an annular space surrounding the quench chamber outlet 214, as indicated by arrow 224. A recirculation line 226 may convey the fines water to the quench chamber 60, so that the water may be recycled through the system 10. An additional line 227 may direct fines water from the quench chamber 60 (e.g., sump of the quench chamber 60) toward the black water flash system 146. In other embodiments, line 226 may convey the fines water directly to the black water flash system 146, without recycling to the quench chamber 60. In some embodiments, the flush water may be injected upstream of the slag crusher 72 to minimize a flushing of slag carried away with the wash water. In other embodiments, the wash water rate may be adjusted to control an approximate amount of fines that pass through the multi-feeder assembly 12.

Although not shown, the multi-feeder assembly 12 of FIG. 4 may include the controller 28 for controlling the drive motor 204, the supply and venting of the pressurized buffer gas, the slag crusher 72, a solid feed rate of the multi-stage solids feeder 206, the startup/safety valve 116, the wash water supply 220, and so forth. The controller 28 may control these components based on feedback from the sensors 34 located throughout the system 10, as described in detail above with respect to FIG. 2. The controller 28 may execute the same, similar, or different procedures than those described with respect to FIGS. 2 and 3 for system startup, shutdown, and/or response to an upset condition (e.g., pressure loss in the multi-feeder assembly 12). It should be noted that other arrangements and combinations of solids feeders may be used in the multi-feeder assembly 12 for continuous liquid removal from the solids flow 22.

Technical effects of embodiments of the invention include, among other things, the ability to continuously and simultaneously dewater and depressurize a solids flow, such as slag removed from a gasifier. Presently contemplated embodiments of the multi-feeder assembly are capable of handling a solids flow continuously, instead of cycling the solids flow through a dewatering and depressurization process in batch mode. In addition, the disclosed multi-feeder assembly may operate as a single unit to simultaneously reduce the amount of liquid in a solids flow and depressurize the solids flow. Thus, the continuous operation of the disclosed embodiments provides a significant improvement over other liquid removal systems (e.g., lockhoppers), by reducing system interruptions and outputting a continuous flow of dewatered slag. The disclosed multi-feeder assembly also may be more compact than other systems used to remove slag from a gasifier. Therefore, the disclosed multi-feeder assembly may occupy a relatively smaller space beneath the quench chamber of the gasifier, allowing the gasification system to employ a less extensive support structure for elevating the gasifier.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a multi-feeder assembly, comprising:

a first solids feeder configured to receive a solids flow from an upstream system;

a liquid removal section directly coupled to the first solids feeder, wherein the liquid removal section is configured to receive the solids flow directly from the first solids feeder and reduce an amount of liquid in the solids flow, wherein the liquid removal section comprises an inclined conduit having a gas inlet configured to supply a buffer gas to control a level of a liquid/gas interface within the liquid removal section; and a second solids feeder configured to receive the solids flow from the liquid removal section, wherein the second solids feeder is configured to output the solids flow to a downstream system; and a controller configured to control a first feed rate of the solids flow through the first solids feeder and a second feed rate of the solids flow through the second solids feeder based at least in part on sensor feedback, control the supply of the buffer gas that controls the level of the liquid/gas interface, and control operation of the multi-feeder assembly during a startup mode, a regular operating mode, a shutdown mode, and a pressure loss mode, based at least in part on the sensor feedback, wherein the controller, during the startup mode, is configured to operate the multi-feeder assembly to:

establish a buffer gas flow to the multi-feeder assembly;

control a liquid level in the multi-feeder assembly;

start at least one of the first and second solids feeders;

establish a solids lockup condition in at least one of the first solids feeder or the second solids feeder; or a combination thereof; and wherein the controller is configured to establish the solids lockup condition by adjusting the level of the liquid/gas interface in the multi-feeder assembly or by operating at least one of the first solids feeder or the second solids feeder in reverse.

2. The system of claim 1, wherein the first solids feeder comprises a screw feeder, and the screw feeder is oriented at an incline.

3. The system of claim 1, wherein the liquid removal section is disposed between the first and second solids feeders.

4. The system of claim 3, wherein the first solids feeder comprises a first positive displacement pump, and the second solids feeder comprises a second positive displacement pump.

5. The system of claim 3, wherein the inclined conduit containing the buffer gas blocks passage of the liquid but allows passage of the solids flow.

6. The system of claim 1, wherein the multi-feeder assembly is configured to continuously move the solids flow, remove the liquid from the solids flow, and modify a pressure of the solids flow between the upstream and downstream systems.

7. The system of claim 6, wherein the second solids feeder is configured to reduce a pressure of the solids flow.

8. The system of claim 1, wherein the controller, during the shutdown mode, is configured to operate the multi-feeder assembly to:

control the liquid level in the multi-feeder assembly;

shut down at least one of the first solids feeder or the second solids feeder;

close an upstream valve disposed upstream of the first solids feeder;

depressurize the multi-feeder assembly; or a combination thereof.

9. The system of claim 1, comprising a gasification system coupled to the multi-feeder assembly.

10. The system of claim 1, comprising a wash water supply configured to provide wash water to the liquid removal section for washing the solids flow.

11. The system of claim 1, wherein the inclined conduit excludes a screw feeder configured to rotate about a longitudinal axis of the inclined conduit.

12. The system of claim 1, wherein the controller is configured to establish the solids lockup condition in at least one of the first solids feeder or the second solids feeder by adjusting the level of the liquid/gas interface.

13. A system, comprising:

a multi-feeder assembly, comprising:

a first solids feeder configured to receive a solids flow from an upstream system;

a liquid removal section directly coupled to the first solids feeder, wherein the liquid removal section is configured to receive the solids flow directly from the first solids feeder and reduce an amount of liquid in the solids flow, wherein the liquid removal section comprises an inclined conduit having a gas inlet configured to supply a buffer gas to control a level of a liquid/gas interface within the liquid removal section; and a second solids feeder configured to receive the solids flow from the liquid removal section, wherein the second solids feeder is configured to output the solids flow to a downstream system; and a controller configured to control a first feed rate of the solids flow through the first solids feeder and a second feed rate of the solids flow through the second solids feeder based at least in part on sensor feedback, control the supply of the buffer gas that controls the level of the liquid/gas interface, and establish a solids lockup condition in at least one of the first solids feeder or the second solids feeder by adjusting the level of the liquid/gas interface.

* * * * *